US006402153B1

(12) United States Patent
Stewart

(10) Patent No.: US 6,402,153 B1
(45) Date of Patent: Jun. 11, 2002

(54) CHILDRENS BASKETBALL-TYPE GAME

(75) Inventor: Charles Edward Stewart, Hemet, CA (US)

(73) Assignee: Mattel, Inc, El Segundo, CA (US)

( * ) Notice: Subject to any disclaimer, the term of this patent is extended or adjusted under 35 U.S.C. 154(b) by 0 days.

(21) Appl. No.: 09/631,913

(22) Filed: Aug. 3, 2000

(51) Int. Cl.[7] ..... A63B 63/00; A63F 9/02; F41J 1/00; F41J 5/00

(52) U.S. Cl. ..... 273/317; 473/415

(58) Field of Search ..... 473/415, 480, 473/481, 422; 466/369; 273/317, 317.3

(56) References Cited

U.S. PATENT DOCUMENTS 2,085,161 A * 6/1937 Kraus ..... 482/90
5,267,886 A * 12/1993 Wood et al. ..... 446/175
5,418,517 A * 5/1995 Matherne et al. ..... 340/323 R
5,762,569 A * 6/1998 Hale ..... 473/480
5,779,570 A * 7/1998 Bear ..... 473/481
6,017,261 A * 1/2000 Wachtel ..... 446/301

* cited by examiner

*Primary Examiner*—Paul T. Sewell
*Assistant Examiner*—M. Chambers
(74) *Attorney, Agent, or Firm*—Roy A. Ekstrand

(57) ABSTRACT

A game includes a base and a toy figure holding a basketball-type hoop. The toy figure is resiliently supported upon the base by a spring support. A sensing lever on the figure responds to the passage of a ball through the hoop to provide a first switch condition. A motion sensor within the figure responds to impacts against the figure to provide a second switch condition. A sound and control circuit is operative within the figure and responds to the switch conditions to play appropriate audible messages from a stored memory set.

11 Claims, 4 Drawing Sheets

10
87
21
103
102
101
100
20
24
17
23
35
32
30
43
41
40
112
114
85
31
139
135
42
22
94
93
110
86
91
111
34
92
90
18
76
89
80
75
27
74
81
73
83
72
70
88
71
15
60
82
62
61
12
84
63
13
64
11
65
14
67
66
55

CHILDRENS BASKETBALL-TYPE GAME

FIELD OF THE INVENTION

This invention relates generally to childrens games and particularly those having a basketball-type theme.

BACKGROUND OF THE INVENTION

Basketball games are well known and have become extremely popular for many years. The basic apparatus for basketball play is deceptively simple. A play area or court includes a pair of goals positioned at opposite ends of the court. Each goal includes a support structure such as a vertical post having a generally vertically planar backboard upon which a circular hoop is supported. In most instances, a generally conical net is supported on the underside of the hoop to facilitate the observation of a ball passing through the hoop successively. In addition to standard basketball apparatus, a number of sport, toy and novelty devices having various degrees of similarity to standard basketball have been provided. Sport apparatus similar to standard basketball has included the provision of scoring detectors and indicators as well as associated sound producing devices. The basic objective of such sport apparatus has been the provision of various scoring indicators such as lights and sounds. For the most part, scoring detectors used in the scoring indicators of such apparatus utilize some type of pivotally supported lever or paddle or other type member positioned beneath and extending into the hoop opening. The idea is to utilize the descent of the ball through the hoop opening to move the paddle or other extending device thereby actuating a switch to complete detection of a successful goal.

Toy apparatus having a basketball type theme are, for the most part, smaller than sport apparatus and consequently utilize a smaller ball. The toy apparatus typically is similar in variation to the sport apparatus having a goal detector and indicator device. Novelty apparatus is found in devices such as a basketball hoop-type goal supported upon a waste basket. In such novelty devices, the objective is the utilization of a wadded-up in place of a ball. The wadded-up paper is then shot toward the basketball-type goal and descends through the goal into the waste basket beneath.

Not surprisingly, the extended popularity of such a wide variety of basketball-type apparatus is reflected in a substantial number of patents having been granted thereon. For example, U.S. Pat. No. 5,326,094 issued to Quinn sets forth an AUDIO SPORTS GAME utilizing an audio message generator which selectively generates one of a plurality of audio messages. The message generator is actuated by a switch and generates a message which presents a setting for a user of a sports game. The message is generated prior to and during the user's attempt to cause an object to pass through the hoop of a basketball-type goal or the like.

U.S. Pat. No. 2,534,067 issued to Rubin sets forth an ADJUSTABLE BASKETBALL HOOP MOUNTING having a basketball hoop goal supporting a goal detecting lever and a net. The goal is height adjustable by moving the hoop support upon an elongated vertical rod.

U.S. Pat. No. 2,593,758 issued to Holmdahl sets forth a SIGNAL MEANS FOR BASKETBALL BASKETS having a hoop-type goal supporting a conical net within which a pivotally supported lever is positioned to be pivoted downwardly by the descent of a ball through the hoop.

U.S. Pat. No. 4,244,569 issued to Wong sets forth a BASKETBALL PRACTICING APPARATUS for improving the accuracy of shooting a basketball. The apparatus includes a target such as a highly colored ball and apparatus extending below the basketball hoop for holding the target at the center of the hoop. The holding apparatus permits the target to be easily deflected to allow a basketball to fall through the hoop.

U.S. Pat. No. 5,294,913 issued to Mower, et al. sets forth an INDOOR/OUTDOOR PORTABLE BASKETBALL SCOREBOARD having a pivotally supported lever extending beneath a basketball hoop for detecting the descent of a ball therethrough. A scoreboard apparatus is operatively coupled to the detector and responds to ball detection by altering the scoring depiction.

U.S. Pat. No. 5,163,680 issued to Amron sets forth a BASKETBALL GOAL SIMULATOR having a rim formed of a conductive material and a frusto-conical net suspended from the rim. A ball adapted to fit within the rim includes an outer surface of conductive material such than an electric circuit is completed whenever the ball strikes the rim while passing therethrough.

U.S. Pat. No. 5,074,552 issued to Gomez, et al. sets forth a BASKETBALL-TYPE AMUSEMENT DEVICE having an elongated generally rectangular frame structure supporting a throwing position at one end and a basketball goal at the remaining end. The backboard is offset from a rotary drive system to carry the backboard and the hoop through a horizontally disposed art. Confining walls are provided in the form of an open front structure which is open at the throwing position. A floor is supported within the elongated frame for returning the ball to the shooter.

U.S. Pat. No. 5,443,259 issued to Segan, et al. sets forth a GAME APPARATUS INCLUDING BASKETBALL, PINBALL AND TARGET BOWLING in which a combined assembly supports a plurality of games and a common scorekeeping and control system.

U.S. Pat. No. 5,418,517 issued to Matherne, et al. sets forth a BASKETBALL SCORING APPARATUS having a pivotally supported lever beneath a basketball hoop coupled to a scoreboard indicator. Detecting means within the lever support provide output signals to the scoring indicator as a ball descends through the hoop.

U.S. Pat. No. 5,762,569 issued to Hale sets forth a DEVICE FOR CONVERTING A CONTAINER INTO A FIGURE TO SIMULATE AN INTERACTIVE GAME which includes a headboard in the shape of the head of the figure, a clip attached to the headboard for securing the headboard to the container and a sensor supported at the lower end of the clip for generating an electrical signal in response to impact from an object projected by the game player.

U.S. Pat. No. 5,358,237 issued to Yu sets forth a BASKETBALL GAME ASSEMBLY having a board and a ring secured thereto. The board includes an opening formed in the middle portion and has a door panel pivotally coupled to the board for closing the opening. A beam has one end pivotally coupled to the board and the other end extending into the ring. A lever couples the beam to the door panel. The door panel can be opened by the lever when the beam is depressed by a basketball.

U.S. Pat. No. 5,779,570 issued to Bear sets forth a STUFFED ANIMAL WITH REMOVABLE BASKET FOR A BALLGAME having a stuffed figure resembling a bear in a seated position with arms forward. A basketball structure is removably secured between the forwardly extending arms and includes a net extending down between the legs of the seated figure.

U.S. Pat. No. 4,955,605 issued to Goldfarb sets forth a HOME BASKETBALL APPARATUS having a basketball shooting game device which includes a basketball hoop releasibly securable to the back of a chair or the like.

U.S. Pat. No. 5,064,195 issued to McMahan, et al. sets forth a NOVELTY BASKETBALL GOAL PRODUCING SOUND EFFECTS ON MADE SHOT having a backboard and supported hoop and net securable to the upper rim of a wastebasket. The goal includes a force-activated sensor suspended within the net of the goal by wires which connect the sensor to a sound effects generator. The sensor will activate the sound generator when an object is passed through the basketball hoop.

U.S. Pat. No. 4,480,834 issued to Minami and U.S. Pat. No. 5,876,036 issued to Mathis set forth examples of miniaturized basketball games in which a miniature version of a basketball goal and play apparatus is provided.

U.S. Pat. No. 5,338,044 issued to Mazursky, et al. sets forth a WATER TOY having a fanciful figure supporting a basketball goal and a pair of loosely driven hose elements which are coupled to a source of water under pressure. The hose elements cooperate to provide deflection of a ball shot toward the basketball goal.

U.S. Pat. No. 5,655,979 issued to Blue sets forth a TABLE TENNIS STYLE GAME WITH BASKETBALL BACKBOARDS, HOOPS, NETS AND FOAM BALL in which a table tennis table is provided with a pair of basketball backboards and goals on each side of the transverse net.

U.S. Pat. No. 5,224,699 issued to Zaruba sets forth a BASKETBALL GAME having two hoops supported upon a common backboard while U.S. Pat. No. 5,222,259 issued to Bristor sets forth a SHIRT WITH REMOVABLE BASKETBALL HOOP.

While the foregoing described prior art devices have to some extent improved the art and have in some instances enjoyed commercial success, there remains nonetheless a continuing need in the art for evermore improved, interesting and amusing childrens basketball-type games.

SUMMARY OF THE INVENTION

Accordingly, it is a general object of the present invention to provide an improved childrens basketball type game. It is a more particular object of the present invention to provide an improved childrens basketball-type game which is optimized for the entertainment and amusement of extremely young children.

In accordance with the present invention, there is provided a game apparatus comprising: a base; a toy figure having a pair of arms, a torso, a pair of hands and a head; a resilient support joined to the toy figure and the base; a hoop supported by the toy figure and a ball able to fit through the hoop; a motion responsive switch sensing motion of the toy figure; a sensor switch responsive to passage of the ball through the hoop; a sound and control circuit having means for producing a plurality of audible messages in response to actuation of the motion responsive switch and the sensor switch either alone or concurrently, the toy figure oscillating upon the resilient support and the base when the toy figure or the hoop is impacted by the ball.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
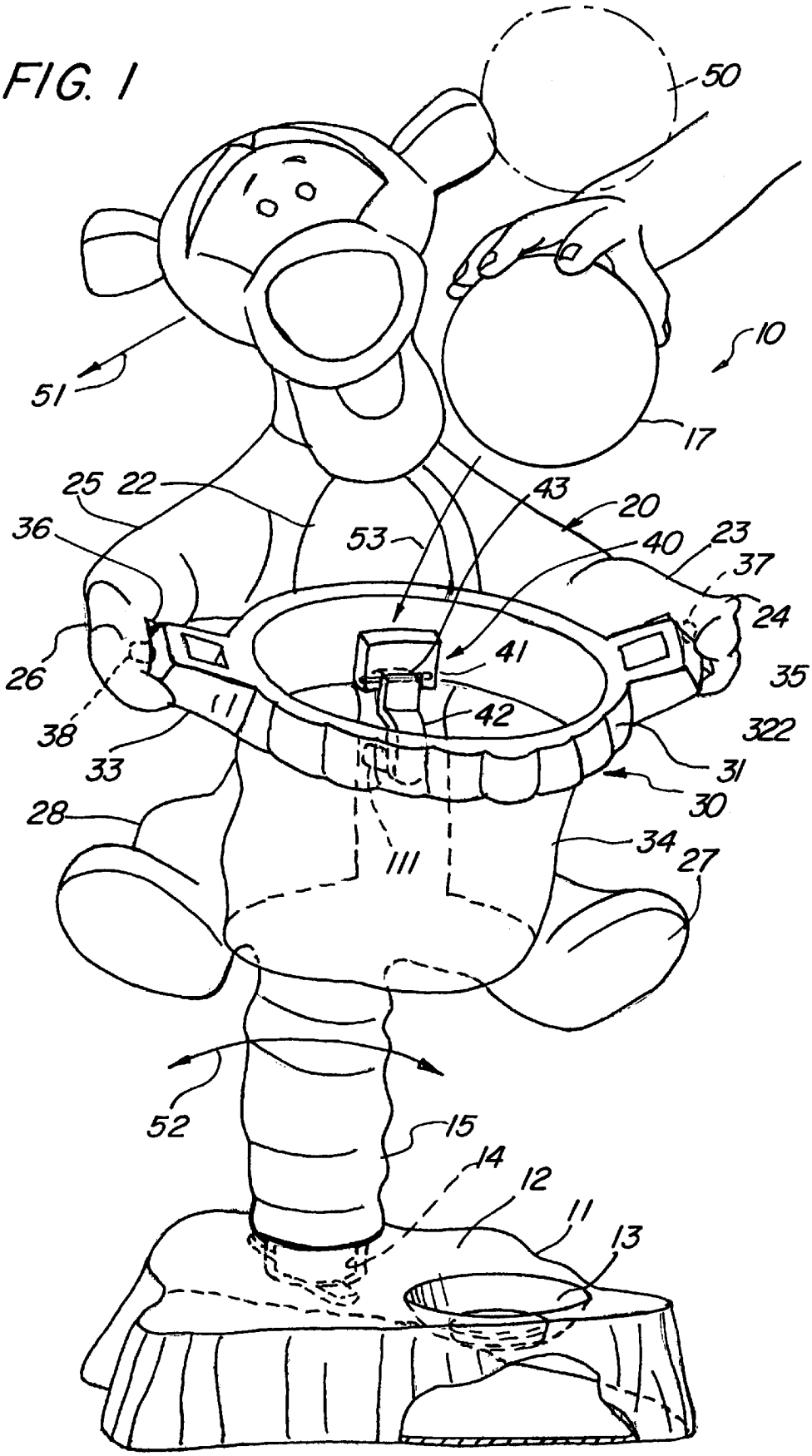
FIG. 1 sets forth a partially sectioned front view of the present invention childrens basketball-type game.

FIG. 1 sets forth a partially sectioned front view of a basketball-type game constructed in accordance with the present invention and generally referenced by numeral 10. Game 10 includes a support base 11 defining an upper surface 12 having a ball recess 13 formed therein. Ball recess 13 operates to provide a convenient place for resting ball 17 when not in use. Base 11 further defines a receptacle 14 set forth below in FIG. 2 in greater detail.

Game 10 further includes a toy FIG. 20 preferably formed of a molded plastic material or the like or alternatively formed of a plush material and having a head 21 supported by a torso 22. Torso 22 supports a pair of arms 23 and 25 having respective hands 24 and 26. Hands 24 and 26 define respective notches 35 and 36. Toy FIG. 20 further includes a pair of legs 27 and 28 in a downwardly extending tail 15. The structure of tail 15 and its internal support is set forth below in FIG. 2 in greater detail. Suffice it to note here that the internal spring support 60 (seen in FIG. 2) within tail 15 resiliently supports toy FIG. 20 upon base 11. Thus, in the preferred fabrication of toy FIG. 20, tail 15 provides a flexible material covering for the spring support which is set forth below in FIG. 2 as spring support 60.

Game 10 further includes a hoop 30 having a generally annular rim 31 supporting a pair of outwardly extending brackets 32 and 33. Brackets 32 and 33 are received within notches 35 and 36 respectively and, by means set forth below in FIG. 3, are secured in a removable attachment. Suffice it to note here that brackets 32 and 33 supports spring-biased posts 37 and 38 which engage hands 24 an 26 in the manner shown in FIG. 3 to secure hoop 30 to toy FIG. 20. Hoop 30 further includes a housing 41 within which a lever 42 is pivotally supported by a hinge 43. By means also set forth below in FIG. 2 in greater detail, toy FIG. 20 supports a forwardly extending button 111 which contacts lever 42. Hoop 30 further supports a flexible open net 34 extending downwardly from rim 31 which is secured thereto by conventional attachment (not shown).

In operation, the child user attempts to drop ball 17 through hoop 30 in accordance with a play pattern similar to basketball. In accordance with the preferred fabrication of the present invention, game 10 is sized to allow a young child to have a downward angle for throwing ball 17 through hoop 30. Thus, as the child user acquires sufficient skill to throw ball 17 in the direction indicated by arrow 53 such that it passes through rim 31, ball 17 pivots lever 42 as it drops through rim 31. The pivotal movement of lever 42 depresses button 11 which, by means set forth below in FIG. 2, sends a trigger signal to the internal circuitry of toy FIG. 20 (seen in FIG. 2). In the preferred fabrication of the present invention, the internal sound and control circuit (seen in FIG. 4) of toy FIG. 20 causes an audible sound message indicating a positive result to be heard by the child user when lever 42 trips button 111.

In further accordance with the present invention, ball 17 may, in addition to passing through hoop 30, incur a substantial impact against either hoop 30 or toy FIG. 20. In such case, the resilient support for toy FIG. 20 provided by the spring support within tail 15 set forth below in FIG. 2 allows toy FIG. 20 to pivot resiliently back and forth upon tail 15 and base 11 in the manner indicated by arrows 52. As toy FIG. 20 oscillates back and forth upon the support structure within tail 15, a motion switch (seen in FIG. 2) supported within torso 22 is actuated providing a second signal input to the control circuitry within toy FIG. 20.

In addition, a further game possibility arises when the user is unsuccessful in throwing ball 17 through hoop 30 and instead directs ball 17 inaccurately as indicated by dash-lined ball representation 50. In such case, ball 50 impacts head 21 or some other portion of toy FIG. 20. The impact against toy FIG. 20 may, for example, drive toy FIG. 20 in the direction indicated by arrow 51 as the resilient support within tail 15 flexes in absorbing the impact energy. In this event, ball 50 is unlikely to pass through hoop 30 and thus sensor 40 is unlikely to be stimulated. However, the momentum responsive switch supported within toy FIG. 20 and shown below as motion switch 103 in FIG. 2 does respond to the impact of ball 50. As a result, the control circuitry within toy FIG. 20 described below responds to this alternative switch input combination to provide an appropriate audible message which is indicative of an unsuccessful result.

In the event the user misses toy FIG. 20 and hoop 30 entirely, neither sensor 40 nor motion switch 103 (seen in FIG. 2) responds and no audible message is produced.

Thus, in accordance with the present invention game play, the combination of possibilities of switch activity states as the child user attempts to throw ball 17 through hoop 30 allow toy FIG. 20 to respond interactively with audible responses to the child user. The resulting game play is extremely enjoyable and amusing to young children and the present invention game presents an extremely user friendly and encouraging figure for game play. In addition, the attachment of hoop 30 to toy FIG. 20 is a removable attachment in accordance with the apparatus set forth below in FIG. 3. This facilitates removing hoop 30 from toy FIG. 20 for additional play patterns which are enhanced by the resilient support provided by spring support 60 (seen in FIG. 2) within tail 15.

Figure 2:
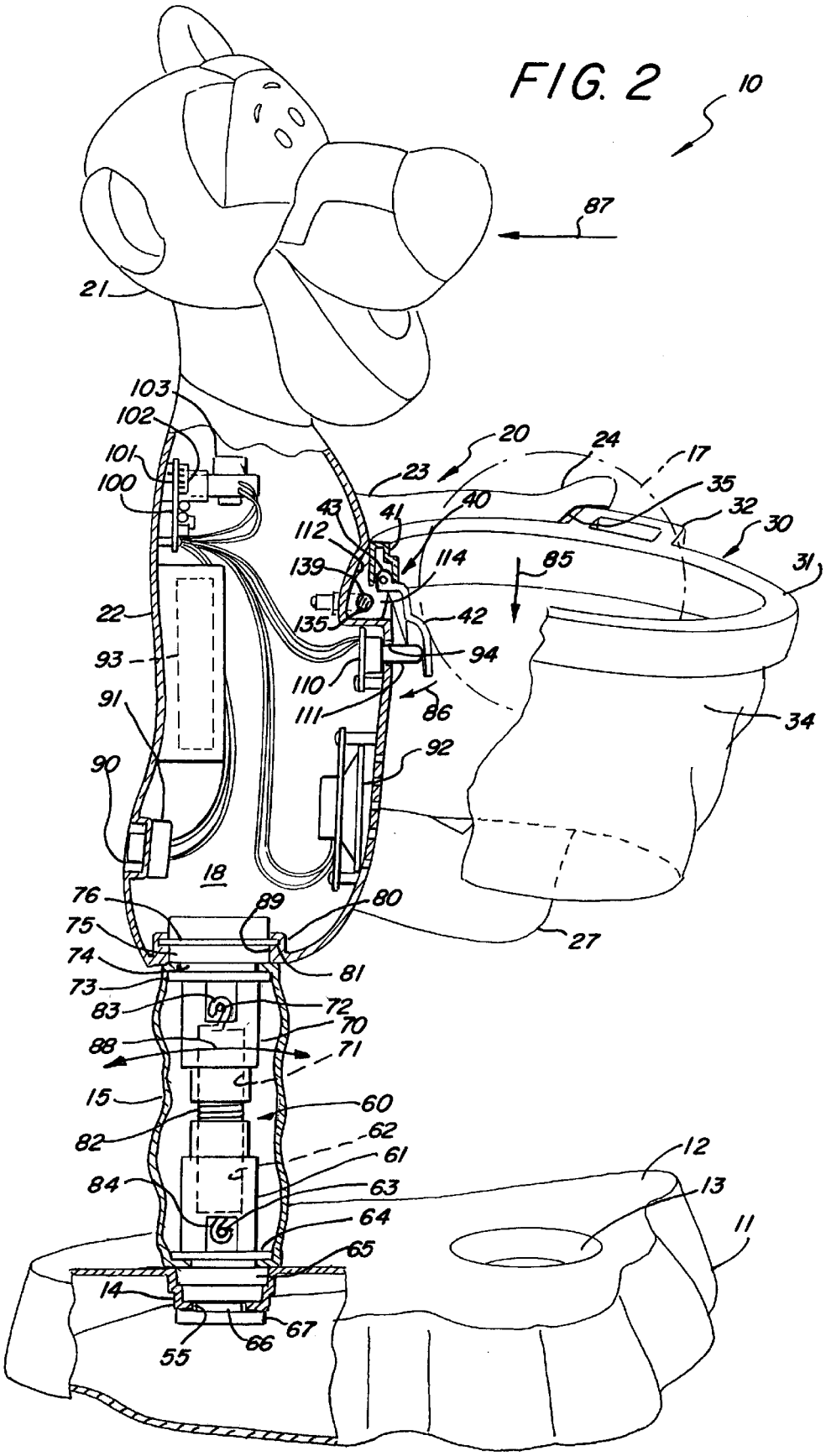
FIG. 2 sets forth a section view of the childrens basketball-type game of FIG. 1.
Figure 3:
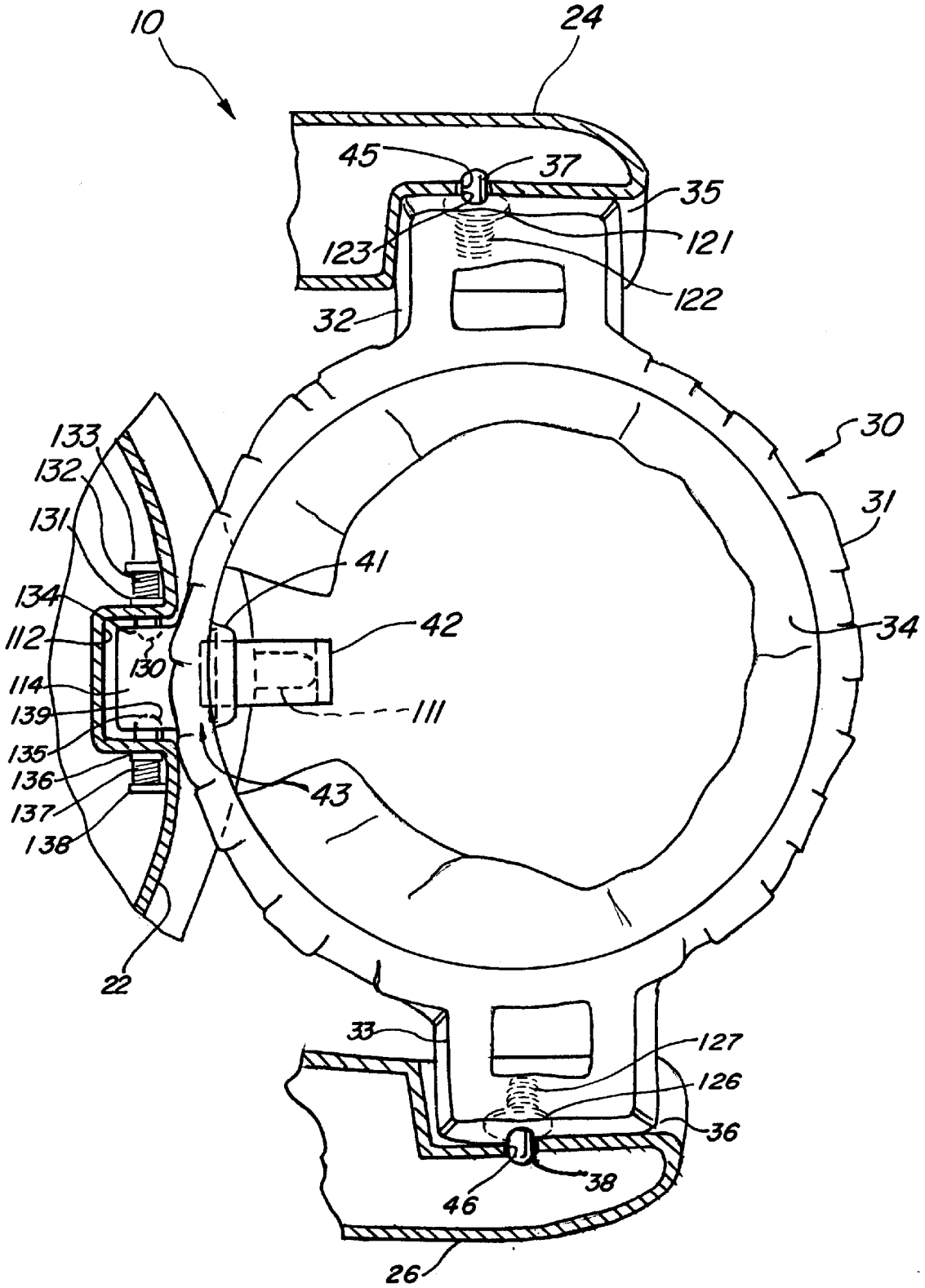
FIG. 3 sets forth a partial section top view of the hoop support portion of the present invention childrens basketball-type game.

FIG. 2 sets forth a partially sectioned side elevation view of game 10. As described above, game 10 includes a base 11 having an upper surface 12 defining a recess 13 and a receptacle 14. Receptacle 14 defines an aperture 55. As is also described above, game 10 includes a toy FIG. 20 having a torso 22 defining an interior cavity 18. Toy FIG. 20 further includes a head 21 supported upon torso 22 and an arm 23 having a hand 24 defining a notch 35. Toy FIG. 20 further includes a tail 15 formed of a resilient material. Torso 22 supports a plurality of conventional batteries 93 and defines a recess 90 having an on/off switch 91 supported thereon. Torso 22 further defines a notch 112 on the frontal surface thereof and an aperture 94 below notch 112.

Figure 4:
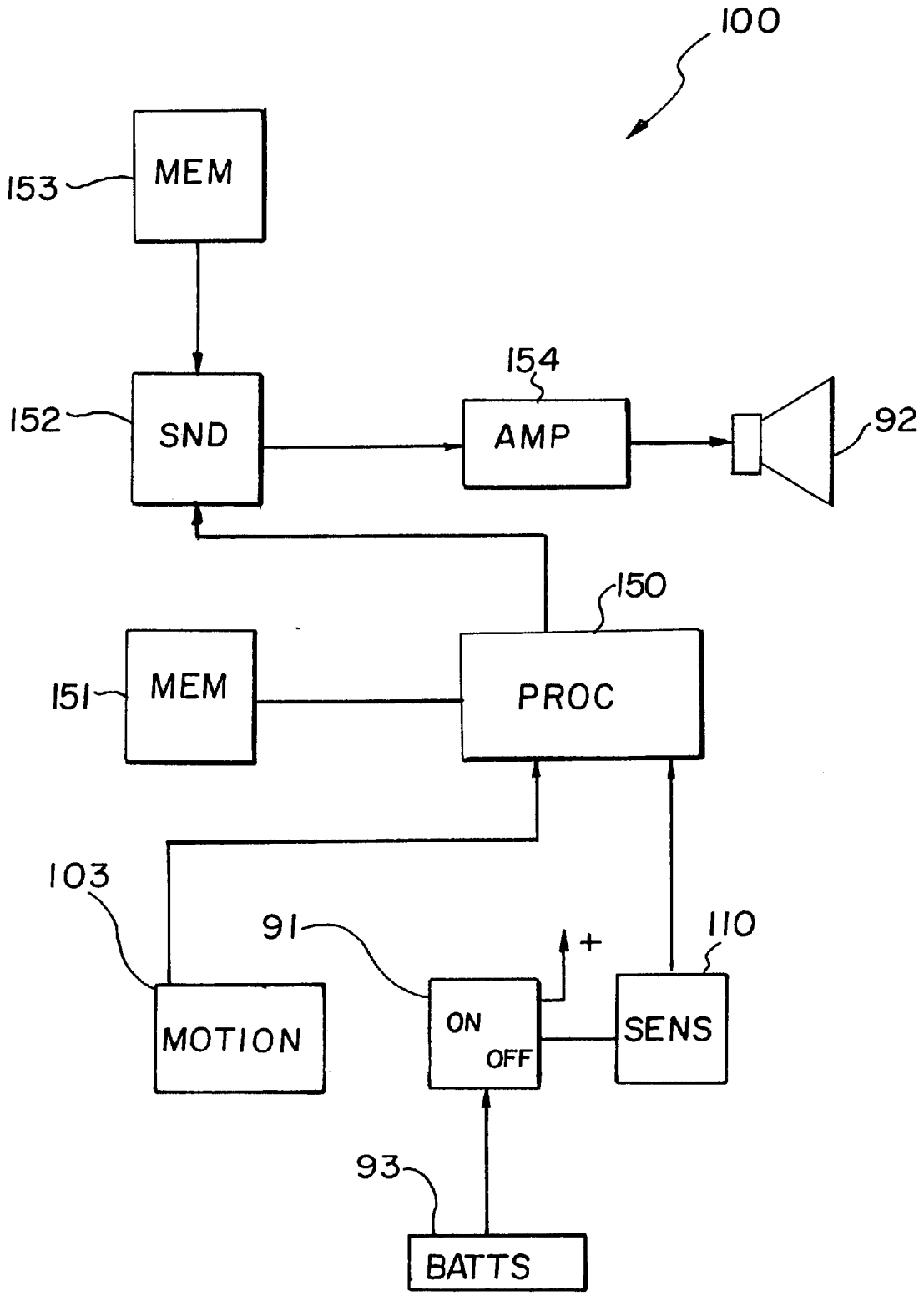
FIG. 4 sets forth a schematic block diagram of the operative electronic circuit means within the present invention childrens basketball-type game.

In further accordance with the present invention, a sound and control circuit 100 set forth below in the block diagram of FIG. 4 is formed upon a conventional printed circuit board 101 having a plurality of electronic components such as components 102. A motion switch 103 is supported within torso cavity 18. A conventional speaker 92 is also supported within interior cavity 18 of torso 22. A sensor switch 110 is supported within torso interior cavity 18 and includes an outwardly extending button 111 which passes through aperture 94.

In further accordance with the present invention, game 10 includes a hoop 30 having an annular rim 31 supporting a net 34. As is better seen in FIG. 3, rim 31 is supported within hands 24 and 26 by a pair of outwardly extending brackets 32 and 33. Rim 31 further defines a rearwardly extending bracket 114 having a housing 41 formed thereon. A lever 42 is pivotally secured within housing 41 by a hinge 43. Lever 42 extends downwardly and rests upon button 111 of sensor switch 110. By means also set forth below in greater detail, bracket 114 is secured within notch 112. However, suffice it to note here that the attachment of bracket 114 includes an aperture 139 formed therein which receives a button 135 supported within notch 112.

Spring support 60 includes a lower post 61 having a passage 62 formed therein. A pin 63 is secured within lower post 61. Lower post 61 further defines a plug 65 which is received within receptacle 14. A spacer 66 extends through aperture 55 of receptacle 14 and supports a latch 67. Latch 67 secures plug 65 within receptacle 14 in a "twist mount" attachment. In addition, lower post 61 defines an outwardly extending flange 64 which captivates the lower end of tail 15.

Spring support 60 further includes an upper post 70 defining a passage 71 therein. Upper post 70 further includes a pin 72 and a flange 73. Flange 73 secures the upper end of tail 15. Upper post 70 further includes a generally cylindrical plug 75 having an outwardly extending flange 76. A receptacle formed at the bottom of torso 22 defines an aperture 89 which receives plug 75. In addition, a groove 81 formed within receptacle 80 receives flange 76 of upper post 70 to secure upper post 70 to torso 22.

In accordance with the preferred fabrication of the present invention, spring support 70 provides a resilient attachment and support between base 11 and toy FIG. 20. In the embodiment of FIG. 2, this resilient support is provided by a spring 82 having a hook 84 at one end received upon pin 63 and a hook 83 at the remaining end received upon pin 72. The size of spring 82 is selected to fit snugly within passages 62 and 71 of lower post 61 and upper post 70 respectively. As a result, spring 82 allows flexible movement along with firm support of toy FIG. 20. In response to impacts against toy FIG. 20 or hoop 30, spring 82 flexes allowing resilient oscillatory movement back and forth of toy FIG. 20 and hoop 30. For purposes of illustration, an impact against head 21 in the direction indicated by arrow 87 flexes spring 82 allowing resilient oscillatory motion of upper post 70 and toy FIG. 20 along with hoop 30 in the directions indicated by arrows 88. It will be understood that impact against toy FIG. 20 and/or hoop 30 from a different direction produces a correspondingly differently directed oscillatory motion as spring 82 flexes.

As described above, motion switch 103 responds to oscillatory motion of toy FIG. 20 to provide a signal to sound and control circuit 100. As is similarly described above, the passage of a ball such as ball 17 (seen in FIG. 1) through rim 31 in the direction indicated by arrow 85 forces lever 42 to pivot inwardly in the direction indicated by arrow 86. This inward movement of lever 42 presses button 111 activating switch 110. As a result, an additional signal input is provided to sound and control circuit 100 by the passage of a ball through rim 31. It will be further apparent to those skilled in the art that both sensor switch 110 and motion switch 103 may be activated by a single shot attempt in the event ball 17 simultaneously impacts against toy FIG. 20 while passing through rim 31. As a result, sound and control circuit 100 has three possible switch combinations to utilize in selecting an appropriate audible message to be played through speaker 92. For example, an audible message in response to the switch condition existing when switch 110 is activated and motion switch 103 is not, may include some reference to a "perfect shot" or the like. Similarly, in the event sensor switch 110 and motion switch 103 are simultaneously actuated, an audible message such as "you almost missed" could be selected. Finally, in the event sensor switch 110 is inactive and motion switch 103 is activated, an audible message such as "sorry, you missed" may be selected for play. Thus, the interactive character and responsiveness of toy FIG. 20 is greatly enhanced by the simultaneous resilient support and shot detection provided by game 10.

FIG. 3 sets forth a partial section toy view of game 10 illustrating the removable attachment of hoop 30. As described above, hoop 30 includes a rim 31 supporting a net 34 and having a pair of outwardly extending brackets 32 and 33. As is also described above, hoop 30 is supported within hands 24 and 26 at notches 35 and 36 respectively of toy FIG. 20 (seen in FIG. 1). In addition, torso 22 defines a notch 112 which receives a bracket 114 formed at the rear portion of rim 31.

By way of overview and in accordance with the preferred fabrication of the present invention, hoop 30 is removable from toy FIG. 20 (seen in FIG. 1) to facilitate different game play with the toy figure. However, it may be desirable for reasons of economy of manufacture or the like to secure hoop 30 to hands 24 and 26 as well as torso 22 in a fixed nonremovable attachment.

Rim 31 supports a housing 41 within which a hinge 43 pivotally supports a downwardly extending lever 42. A button 111 which, as is better seen in FIG. 2 extends outwardly from sensor switch 110, is positioned in contact with lever 42.

Hand 24 defines an aperture 45 within notch 35 while bracket 32 of hoop 30 defines an aperture 123 through which a post 37 extends. Post 37 is resiliently supported within bracket 32 by a flange 121 and a spring 122. Thus, the resilient support of post 37 by bracket 32 allows removal of bracket 32 from hand 24.

The attachment of bracket 33 to hand 26 is substantially identical in that hand 26 defines an aperture 46 through which a post 38 extends. Bracket 33 defines an aperture 124 through which post 38 extends. Flange 126 and spring 127 cooperate to resiliently support post 38 allowing removable attachment between bracket 33 and hand 26.

A similar pair of resiliently supported posts 130 and 135 are supported within notch 112 and are received within apertures 134 and 139 of bracket 114. Thus, posts 130 and 135 are resiliently supported within torso 22 by the cooperation of flanges 131 and 136, springs 132 and 137 and tabs 133 and 138. In this manner, the attachment of bracket 114 within notch 111 is also removable whereby hoop 30 may be entirely removed from the toy figure.

FIG. 4 sets forth a block diagram of sound and control circuit 100. Sound and control circuit 100 includes a microprocessor 150 having an associated memory 151. Processor 150 receives inputs from a motion switch 103 and a ball sensor switch 110. In addition, circuit 100 includes an on/off switch 91 coupled to a plurality of conventional batteries 93. While not seen in FIG. 4, it will be understood that on/off button 91 couples an operating supply voltage from batteries 93 to the entire operative circuit of sound and control circuit 100.

Sound and control circuit 100 further includes a sound processor 152 having an associated memory 153. The output of sound processor 152 is coupled to an audio amplifier 154 which in turn drives a speaker 92.

Microprocessor 150 operates in accordance with conventional fabrication techniques in response to the input signals from motion switch 103 and sensor switch 110 to respond to the stored program within memory 151. Memory 151 includes a stored instruction set which configures processor 110 to respond in a predetermined manner as motion switch 103 and/or sensor switch 110 is actuated. Thus, the stored instruction set within memory 151 causes processor 150 to produce a first output signal for coupling to sound processor 152 when neither of switches 103 or 117 are actuated. A second signal output is provided by processor 150 when motion switch 103 is solely actuated and a third output signal condition is provided when sensor switch 110 is solely actuated. Finally, a fourth signal output condition is produced by processor 150 when both switches 103 and 110 are concurrently actuated. As a result, memory 151 and processor 150 operate in a simple and conventional "truth table" type of operation.

Sound processor 152 is fabricated in accordance with conventional fabrication techniques and uses an internal memory 153 having stored audio data therein. Sound processor 152 responds to input signals from processor 150 to select from among a number of audio messages stored within memory 153. It will be well understood by those skilled in the art that virtually any sound processor or "sound chip" circuit may be utilized in place of sound processor 152 and memory 153. The essential characteristic of sound processor 152 is the provision of appropriate signals to amplifier 154 for driving speaker 92 to audiblize a predetermined speech message or sound combination. For example, a combination of a microprocessor, read only memory, speech synthesizer, an audio output amplifier suitable for the functioning of sound processor 152, memory 153 and amplifier 154 is formed as a single integrated circuit chip device manufactured by Texas Instruments, Inc. under the device name TMS50C44. However, it will be understood that a variety of integrated circuit devices may be utilized for the functions of sound processor 152, memory 153 and amplifier 154.

In this manner, sound circuit 100 operates to produce an audible message suitable for the four possible switch conditions arising from actuation or nonactuation of switches 103 and 110.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game apparatus comprising:

a base;

a toy figure having a pair of arms, a torso, a pair of hands and a head;

a resilient support joined to said toy figure and said base;

a hoop supported by said toy figure and a ball able to fit through said hoop;

a motion responsive switch sensing motion of said toy figure;

a sensor switch responsive to passage of said ball through said hoop;

a sound and control circuit having means for producing a plurality of audible messages in response to actuation of said motion responsive switch and said sensor switch either alone or concurrently, said toy figure oscillating upon said resilient support and said base when said toy figure or said hoop is impacted by said ball.

2. The game apparatus set forth in claim 1 wherein said toy figure includes a tail extending between said torso and said base and wherein said tail includes said resilient support.

3. The game apparatus set forth in claim 2 wherein said resilient support includes an upper post joined to said torso, a lower post joined to said base and a spring coupled between said upper and lower posts.

4. The game apparatus set forth in claim 3 wherein said motion responsive switch is supported within said torso.

5. The game apparatus set forth in claim 4 wherein said sensor switch includes a lever pivotally supported within said hoop.

6. The game apparatus set forth in claim 5 wherein said sound and control circuit produces a first audible message when said motion responsive switch is actuated alone and a second audible message when said sensor switch is actuated.

7. The game apparatus set forth in claim 1 wherein said sound and control circuit produces a first audible message when said motion responsive switch is actuated alone and a second audible message when said sensor switch is actuated.

8. The game apparatus set forth in claim 7 wherein said toy figure includes a tail extending between said torso and said base and wherein said tail includes said resilient support.

9. The game apparatus set forth in claim 8 wherein said resilient support includes an upper post joined to said torso, a lower post joined to said base and a spring coupled between said upper and lower posts.

10. The game apparatus set forth in claim 9 wherein said motion responsive switch is supported within said torso.

11. A game apparatus comprising:

a base;

a toy figure having arms, a torso and a hoop held in said arms;

a spring support resiliently supporting said toy figure above said base;

a ball sized to fit through said hoop;

first switch means responsive to motion of said toy figure;

second switch means responsive to the passage of said ball through said hoop; and means responsive to said first and second switch means for producing a first audible message when said first switch means is actuated alone and for producing a second audible message when said second switch means is actuated.

* * * * *